US012796738B2

(12) United States Patent
Lu et al.

(10) Patent No.: US 12,796,738 B2
(45) Date of Patent: Nov. 17, 2026

(54) VAPORIZER AND ELECTRONIC VAPORIZATION DEVICE

(71) Applicant: SHENZHEN FIRST UNION TECHNOLOGY CO., LTD., Shenzhen City (CN)

(72) Inventors: Linhai Lu, Shenzhen City (CN); Zhongli Xu, Shenzhen City (CN); Yonghai Li, Shenzhen City (CN)

(73) Assignee: SHENZHEN FIRST UNION TECHNOLOGY CO., LTD., Shenzhen City (CN)

( * ) Notice: Subject to any disclaimer, the term of this patent is extended or adjusted under 35 U.S.C. 154(b) by 405 days.

(21) Appl. No.: 18/564,085

(22) PCT Filed: May 23, 2022

(86) PCT No.: PCT/CN2022/094508

§ 371 (c)(1),
(2) Date: Nov. 25, 2023

(87) PCT Pub. No.: WO2022/247799

PCT Pub. Date: Dec. 1, 2022

(65) Prior Publication Data

US 2025/0098773 A1 Mar. 27, 2025

(30) Foreign Application Priority Data

May 25, 2021 (CN) ..... 202121128647.4

(51) Int. Cl.
*A24F 40/485* (2020.01)
*A24F 40/10* (2020.01)
*A24F 40/42* (2020.01)

(52) U.S. Cl.
CPC ..... *A24F 40/485* (2020.01); *A24F 40/10* (2020.01); *A24F 40/42* (2020.01)

(58) Field of Classification Search
CPC ..... A24F 40/485; A24F 40/42
See application file for complete search history.

(56) References Cited

U.S. PATENT DOCUMENTS

2018/0184714 A1 7/2018 Liu

FOREIGN PATENT DOCUMENTS

CN 109452691 A * 3/2019 ..... A24F 47/008
CN 211379632 U 9/2020

(Continued)

OTHER PUBLICATIONS

English machine translation of CN109452691A (Year: 2019).*

(Continued)

*Primary Examiner* — Robert C Dye
(74) *Attorney, Agent, or Firm* — Scully, Scott, Murphy & Presser, P.C.

(57) ABSTRACT

This application discloses a vaporizer which includes: a housing, having a liquid storage cavity; a vaporization assembly, configured to vaporize a liquid substrate, where the vaporization assembly has a first side facing the liquid storage cavity and a second side opposite to the first side; a holder, having a holding space in fluid communication with the liquid storage cavity; a flexible seal element, at least partially located between the holder and the vaporization assembly, where the seal element has an interference fit region, and is configured to provide seal between the holder and the vaporization assembly; and an air channel, formed between the seal element and an inner surface of the holding space, to provide an airflow path, and extends through the interference fit region in a direction from the second side toward the first side to replenish air to the liquid storage cavity to relieve negative pressure.

19 Claims, 7 Drawing Sheets

(56) References Cited

FOREIGN PATENT DOCUMENTS

| | | | |
|---|---|---|---|
| CN | 112353002 | A | 2/2021 |
| CN | 212590252 | U | 2/2021 |
| CN | 212814258 | U | 3/2021 |
| CN | 212852491 | U | 4/2021 |
| CN | 215347020 | U | 12/2021 |
| CN | 215347030 | U | 12/2021 |
| CN | 215347044 | U | 12/2021 |
| CN | 215684777 | U | 2/2022 |
| CN | 215684857 | U | 2/2022 |
| WO | 2022/188874 | A1 | 9/2022 |

OTHER PUBLICATIONS

European Communication dated Mar. 13, 2026 received in European Application No. 22810524.3.
European Communication dated Sep. 9, 2024 received in European Application No. 22810524.3.

* cited by examiner

VAPORIZER AND ELECTRONIC VAPORIZATION DEVICE

CROSS-REFERENCE TO RELATED APPLICATIONS

This application is a 35 U.S.C. § 371 National Phase conversion of International (PCT) Patent Application No. PCT/CN2022/094508, filed on May 23, 2022, which claims priority to Chinese Patent Application No. 202121128647.4 filed with China National Intellectual Property Administration on May 25, 2021 and entitled "VAPORIZER AND ELECTRONIC VAPORIZATION DEVICE", which is incorporated herein by reference in its entirety. The PCT International Patent Application was filed and published in Chinese.

TECHNICAL FIELD

Embodiments of this application relate to the field of electronic vaporization technologies, and in particular, to a vaporizer and an electronic vaporization device.

BACKGROUND

There are aerosol-providing articles, for example, e-cigarette devices. The devices generally include e-liquid. The e-liquid is heated to be vaporized, so as to generate an inhalable vapor or aerosol. The e-liquid may include nicotine and/or aromatics and/or an aerosol-generation article (for example, glycerol), except for the aromatics in the e-liquid.

An existing e-cigarette device generally includes a porous ceramic body that has a large amount of micropores provided inside and is configured to absorb and conduct the e-liquid, and a heating element is arranged on a surface of the porous ceramic body and configured to heat and vaporize the absorbed e-liquid. The micropores in the porous body are used as channels for the e-liquid to infiltrate and flow to a vaporization surface, and are also used as air exchange channels for air to be supplemented from the outside and enter an e-liquid storage cavity to maintain air pressure balance in the e-liquid storage cavity after the e-liquid in the e-liquid storage cavity is consumed. In this way, bubbles are generated in the porous ceramic body when the e-liquid is heated, vaporized, and consumed, and then the bubbles emerge from an e-liquid absorbing surface and then enter the e-liquid storage cavity.

For the existing e-cigarette device, as the e-liquid in the liquid storage cavity arranged inside is consumed, the liquid storage cavity is gradually in a negative pressure state, to prevent fluid transmission to a certain extent, so that the e-liquid is less conveyed to the vaporization surface through the micropore channels of the porous ceramic body for vaporization. Particularly, when the existing e-cigarette device is in a continuous inhaling and use state, the air outside the liquid storage cavity is difficult to pass through the micropore channels of the porous ceramic body to enter the liquid storage cavity in a short time, to slow down the speed of conveying the q-liquid to the vaporization surface, and insufficient e-liquid supplied to the heating element will cause the temperature of the heating element to be excessively high, resulting in decomposition and volatilization of the e-liquid components to generate harmful substances such as formaldehyde.

SUMMARY

An embodiment of this application provides a vaporizer, including:

a housing, having a liquid storage cavity configured to store a liquid substrate;

a vaporization assembly, configured to vaporize at least a part of the liquid substrate to generate an aerosol, where the vaporization assembly has a first side facing the liquid storage cavity and a second side opposite to the first side;

a holder, having a holding space in fluid communication with the liquid storage cavity, where the vaporization assembly is at least partially accommodated in the holding space;

a flexible seal element, at least partially located between the holder and the vaporization assembly, where the seal element has an interference fit region, and is configured to provide seal between the holder and the vaporization assembly through interference fit; and an air channel, formed between the seal element and an inner surface of the holding space, to provide an airflow path for air to enter the liquid storage cavity, where the air channel extends through the interference fit region in a direction from the second side toward the first side.

In a preferred implementation, a convex rib at least partially surrounding the seal element is arranged on an outer surface of the seal element, and the convex rib defines the interference fit region.

In a preferred implementation, the air channel includes a first channel portion facing away from the liquid storage cavity and a second channel portion close to the liquid storage cavity in a longitudinal direction of the housing, where the first channel portion extends through the interference fit region, and the second channel portion avoids the interference fit region.

In a preferred implementation, the first channel portion and the second channel portion are relatively staggered in the longitudinal direction of the housing.

In a preferred implementation, the first channel portion has a larger cross-sectional area than the second channel portion.

In a preferred implementation, the inner surface of the holding space is provided with a first vent groove and is at least partially defined by the first vent groove to form the first channel portion; and the outer surface of the seal element is provided with a second vent groove and is at least partially defined by the second vent groove to form the second channel portion, where an extension length of the first vent groove in the longitudinal direction of the housing at least partially overlaps an extension length of the second vent groove, and the first vent groove is in airflow communication with the second vent groove at an overlapping portion.

In a preferred implementation, an outer surface of the holder is provided with a capillary groove at least partially extending in a circumferential direction of the holder; and the capillary groove is arranged to extend through the overlapping portion, and forms a hole at an intersection with the overlapping portion for air to enter the overlapping portion.

In a preferred implementation, the inner surface of the holding space is provided with a first vent groove extending in the longitudinal direction of the housing, and the first vent groove includes a first section facing away from the liquid storage cavity and a second section close to the liquid storage cavity, where the first section has a width, a depth, and a cross-sectional area that are greater than a width, a depth, and a cross-sectional area of the second section; and the first section at least partially defines the first channel portion, and the second section at least partially defines the second channel portion.

In a preferred implementation, a boss opposite to the second section is arranged on the outer surface of the seal element, and a space between the boss and the second section defines the second channel portion.

In a preferred implementation, the seal element is provided with a notch formed in the interference fit region; and the notch at least partially defines the first channel portion.

In a preferred implementation, at least two convex edges are arranged on the outer surface of the seal element, and a gap between the at least two convex edges forms the second channel portion.

In a preferred implementation, the vaporization assembly includes a liquid channel running through the vaporization assembly in a length direction, and is in fluid communication with the liquid storage cavity through the liquid channel to absorb the liquid substrate; and the seal element includes a side wall opposite to the liquid channel in the length direction, and the second channel portion is defined between the side wall and the inner surface of the holding space.

In a preferred implementation, the vaporizer further includes:

a vaporization chamber, at least partially defined by the vaporization assembly, and configured to accommodate the aerosol generated by the vaporization assembly, where the first channel portion is in communication with the vaporization chamber, to allow air in the vaporization chamber to enter the liquid storage cavity during use.

In a preferred implementation, the air channel includes a first vent groove formed on the inner surface of the holding space; and/or the air channel includes a second vent groove formed on the outer surface of the seal element.

Another embodiment of this application further provides an electronic vaporization device, including a vaporizer for vaporizing a liquid substrate to generate an aerosol, and a power supply mechanism for supplying power to the vaporizer. The vaporizer includes the vaporizer described above.

In the foregoing vaporizer, an air channel that extends through the interference fit region is formed between the seal element and the holding space of the holder, to replenish air to the liquid storage cavity to relieve negative pressure.

BRIEF DESCRIPTION OF THE DRAWINGS

One or more embodiments are exemplarily described with reference to the corresponding figures in the accompanying drawings, and the exemplary descriptions are not to be construed as limiting the embodiments. Elements in the accompanying drawings that have same reference numerals are represented as similar elements, and unless otherwise particularly stated, the figures in the accompanying drawings are not drawn to scale.

DETAILED DESCRIPTION

For ease of understanding of this application, this application is described in more detail below with reference to the accompanying drawings and specific implementations.

Figure 1:
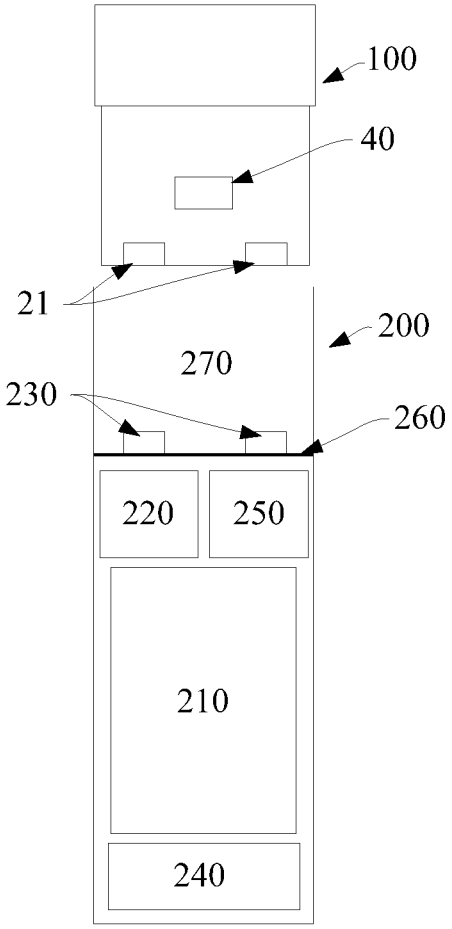
FIG. 1 is a schematic structural diagram of an electronic vaporization device according to an embodiment of this application.

An embodiment of this application provides an electronic vaporization device. Referring to FIG. 1, the electronic vaporization device includes: a vaporizer 100, configured to store a liquid substrate and vaporize the liquid substrate to generate an aerosol; and a power supply mechanism 200, configured to supply power to the vaporizer 100.

In an optional implementation, as shown in FIG. 1, the power supply mechanism 200 includes: a receiving cavity 270, arranged at an end along a length direction and configured to receive and accommodate at least a part of the vaporizer 100; and a first electrical contact 230, at least partially exposed on a surface of the receiving cavity 270, configured to be electrically connected to the vaporizer 100 to supply power to the vaporizer 100 when at least a part of the vaporizer 100 is received and accommodated in the power supply mechanism 200.

According to a preferred implementation shown in FIG. 1, an end portion of the vaporizer 100 opposite to the power supply mechanism 200 along the length direction is provided with a second electrical contact 21, so that when at least a part of the vaporizer 100 is received in the receiving cavity 270, the second electrical contact 21 forms conductivity through being in contact with and abutting against the first electrical contact 230.

A seal element 260 is arranged inside the power supply mechanism 200, and at least a part of an internal space of the power supply mechanism 200 is separated through the seal element 260 to form the receiving cavity 270. In the preferred implementation shown in FIG. 1, the seal element 260 is configured to extend along a cross section direction of the power supply mechanism 200, and is preferably prepared by a flexible material such as silica gel, so as to prevent the liquid substrate seeping from the vaporizer 100 to the receiving cavity 270 from flowing to a controller 220, a sensor 250, and other components inside the power supply mechanism 200.

In the preferred implementation shown in FIG. 1, the power supply mechanism 200 further includes a battery cell 210, located at another end facing away from the receiving cavity 270 along the length direction, and configured to supply power; and a controller 220, arranged between the battery cell 210 and an accommodating cavity, and operably guiding a current between the battery cell 210 and the first electrical contact 230.

During use, the power supply mechanism 200 includes a sensor 250, configured to sense an inhalation flow generated by the vaporizer 100 during inhalation, so that the controller 220 controls the battery cell 210 to output the current to the vaporizer 100 according to a detection signal of the sensor 250.

Further, in the preferred implementation shown in FIG. 1, a charging interface 240 is arranged on another end of the power supply mechanism 200 facing away from the receiving cavity 270, and is configured to supply power to the battery cell 210.

The embodiments in FIG. 2 to FIG. 5 are schematic structural diagrams of the vaporizer 100 in FIG. 1 according to an embodiment. The vaporizer 100 includes:

a main housing 10. According to FIG. 2 and FIG. 3, the main housing 10 is generally in a flat cylindrical shape; and the main housing 10 has a near end 110 and a far end 120 opposite to each other in the length direction. According to requirements for common use, the near end 110 is configured as an end for a user to inhale the aerosol, and a suction nozzle A for the user to inhale is arranged at the near end 110; and the far end 120 is used as an end combined with the power supply mechanism 200, and the far end 120 of the main housing 10 is an opening on which a detachable end cap 20 is mounted. The opening is configured to mount necessary functional components inside the main housing 10.

Figure 2:
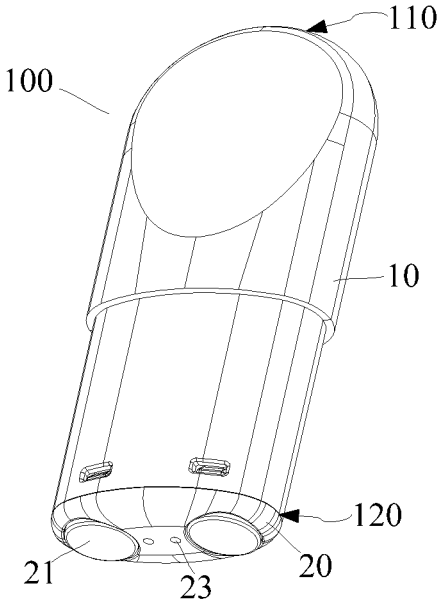
FIG. 2 is a schematic structural diagram of a vaporizer shown in FIG. 1 from a perspective.
Figure 3:
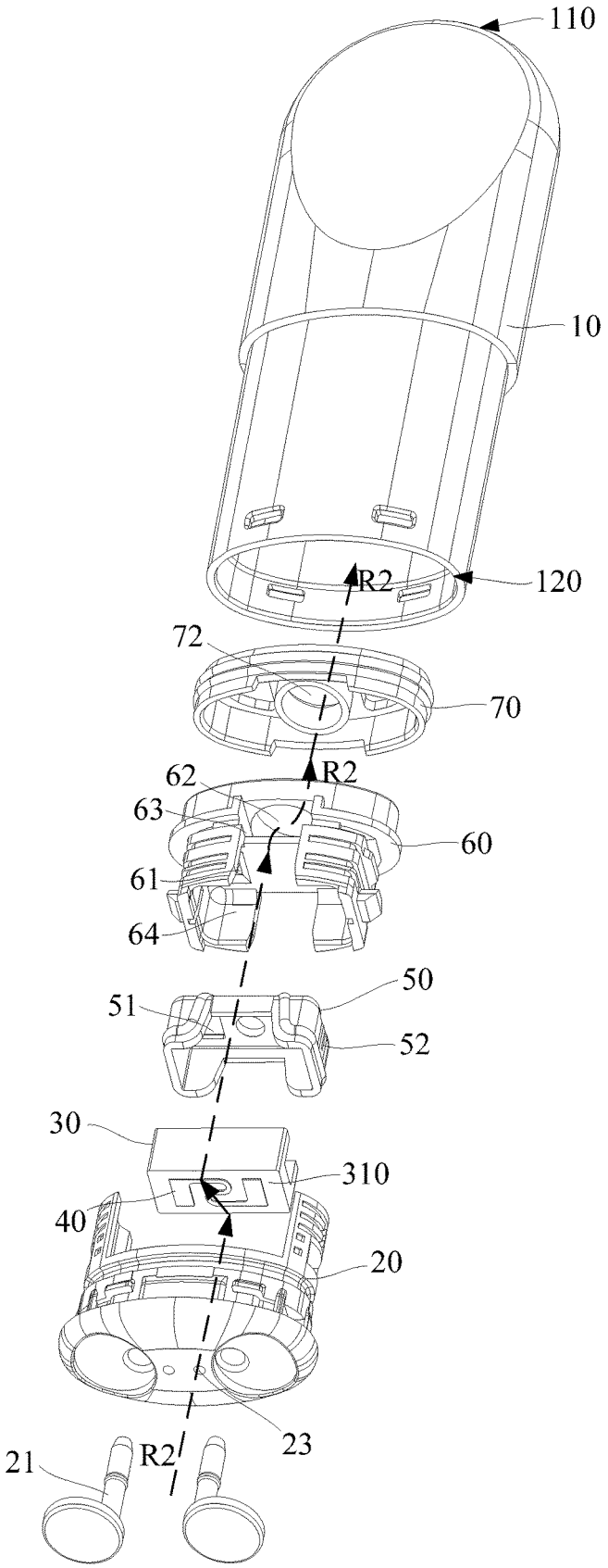
FIG. 3 is a schematic exploded view of the vaporizer shown in FIG. 2 from a perspective.
Figure 4:
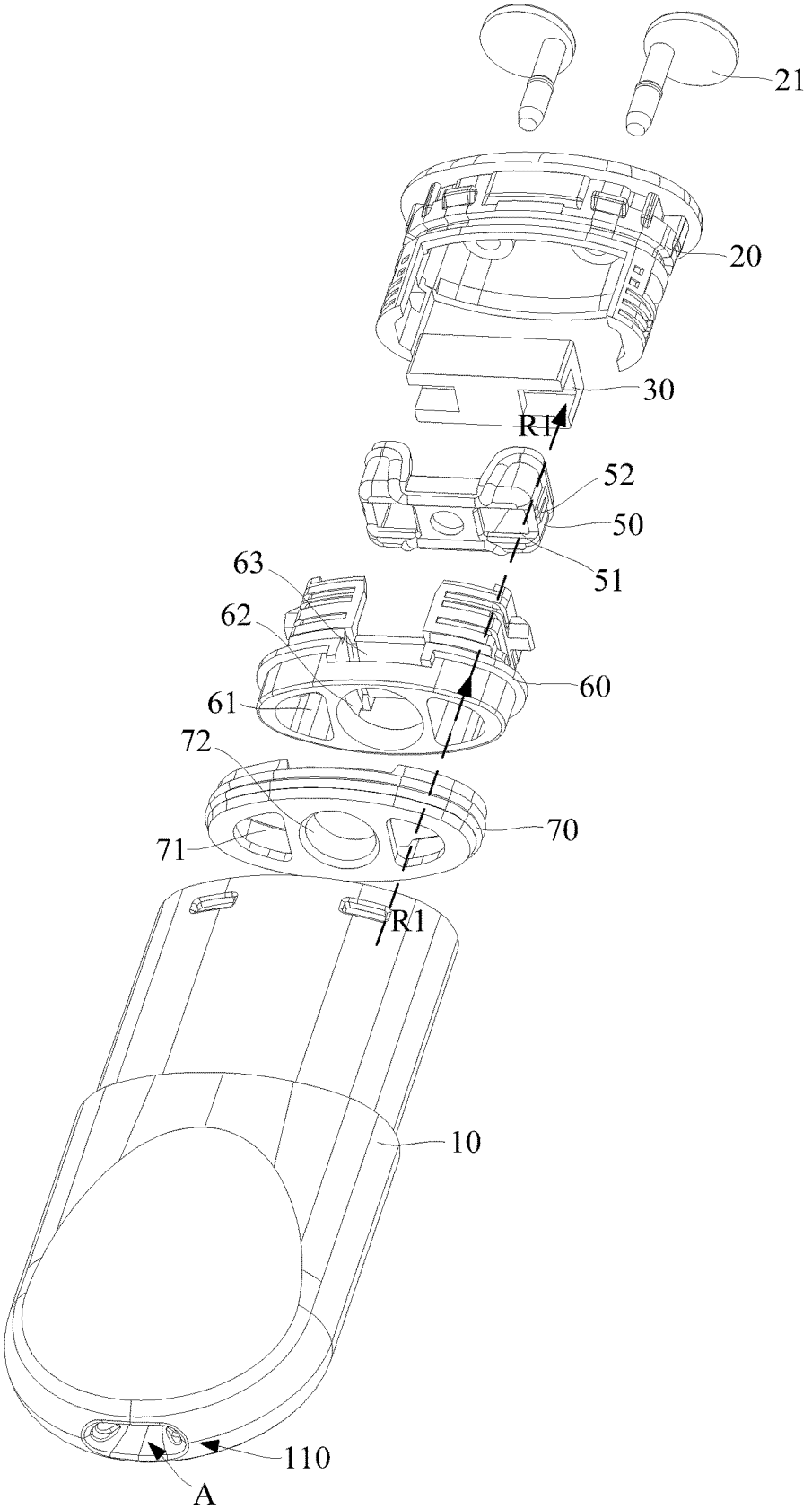
FIG. 4 is a schematic exploded view of the vaporizer shown in FIG. 2 from another perspective.

Further, in a specific implementation shown in FIG. 2 to FIG. 4, the second electrical contact 21 is penetrated into the vaporizer 100 from a surface of the end cap 20, so that at least a part of the second electrical contact 21 is exposed outside the vaporizer 100, so as to form conductivity through being in contact with the first electrical contact 230. In addition, the end cap 20 is further provided with a first air inlet 23, configured to supply external air into the vaporizer 100 during inhalation.

Figure 5:
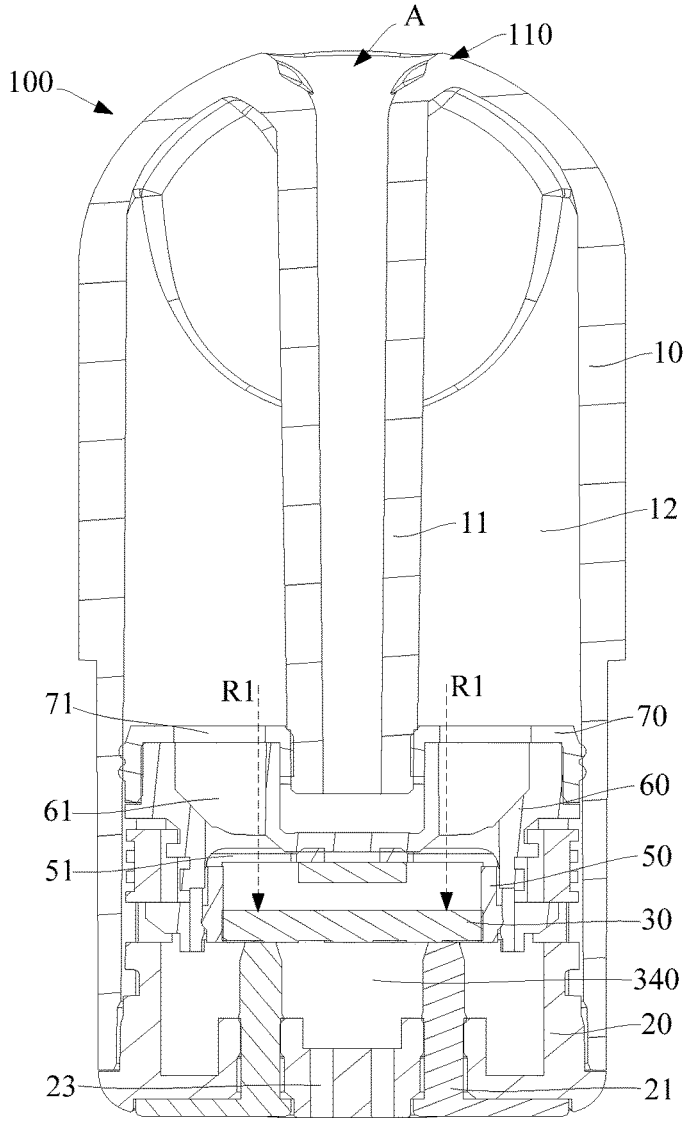
FIG. 5 is a schematic cross-sectional view of the vaporizer shown in FIG. 2 from a perspective.

Further referring to FIG. 3 to FIG. 5, the main housing 10 is internally provided with a liquid storage cavity 12 for storing the liquid substrate, and a vaporization assembly for absorbing the liquid substrate from the liquid storage cavity 12, and heating and vaporizing the liquid substrate. The vaporization assembly generally includes a capillary liquid guide element for absorbing the liquid substrate, and a heating element combined with the liquid guide element. The heating element heats at least a part of the liquid substrate in the liquid guide element to generate the aerosol during power on. In an optional implementation, the liquid guide element includes flexible fibers such as cotton fibers, non-woven fabrics, and glass fiber ropes, or includes porous materials with a microporous structure, such as porous ceramics, foam metal, and the like. The heating element can be combined onto the liquid guide element or wound on the liquid guide element through printing, deposition, sintering, physical assembly, or the like.

Further, in the preferred implementations shown in FIG. 3 to FIG. 5, the vaporization assembly includes: a porous body 30, configured to absorb and transfer the liquid substrate, and a heating element 40 configured to heat and vaporize the liquid substrate absorbed by the porous body 30. Specifically, in the schematic structural cross-sectional view shown in FIG. 5, a flue gas transmission pipe 11 extending an axial direction is arranged inside the main housing 10; and the main housing 10 is further internally provided with a liquid storage cavity 12 configured to store the liquid substrate. During implementations, at least a part of the flue gas transmission pipe 11 extends in the liquid storage cavity 12, and the liquid storage cavity 12 is formed by the space between an outer wall of the flue gas transmission pipe 11 and an inner wall of the main housing 10. A first end of the flue gas transmission pipe 11 opposite to the near end 110 is in communication with the suction nozzle A, and a second end opposite to the far end 120 is in airflow connection with a vaporization chamber 340 formed by defining between a vaporization surface 310 of the porous body 30 and the end cap 20, so as to transmit the aerosol generated by the vaporized liquid substrate in the heating element 40 and released to the vaporization chamber 340 to the suction nozzle A for inhalation.

Referring to a structure of the porous body 30 shown in FIG. 3, FIG. 4, and FIG. 5, a shape of the porous body 30 is configured to be substantially, but not limited to, a block structure in this embodiment. According to a preferred design of this embodiment, the porous body 30 is in an arched shape and includes a vaporization surface 310 facing toward the end cap 20 in the axial direction of the main housing 10. During use, a side of the porous body 30 facing away from the vaporization surface 310 is in fluid communication with the liquid storage cavity 12, so as to absorb the liquid substrate, then the microporous structure inside the porous body 30 transmits the liquid substrate to the vaporization surface 310 to be heated and vaporized to form the aerosol, and the formed aerosol is released or escaping from the vaporization surface 310.

Further, the heating element 40 is formed on the vaporization surface 310; and after assembly, the second electrical contact 21 abuts against the heating element 40, so as to supply power to the heating element 40.

Further, referring to FIG. 3 to FIG. 5, in order to assist in the mounting and fixation of the porous body 30 and the sealing of the liquid storage cavity 12, the main housing 10 further includes a flexible second seal element 50, a holder 60 and a flexible first seal element 70, which may not only seal an opening of the liquid storage cavity 12, but also fixe and holds the porous body 30 inside.

For a specific structure and shape, the second seal element 50 is generally in a hollow cylinder shape. The inner hollow is configured to accommodate the porous body 30, and is sleeved or surrounds outside the porous body 30.

The rigid holder 60 holds the porous body 30 sleeved with the second seal element 50. In some embodiments, the holder 60 may have a holding space 64 that includes a substantially open lower end and that is configured to accommodate and hold the second seal element 50 and the porous body 30. On one hand, the second seal element 50 may seal a gap between the porous body 30 and the holder 60 to prevent the liquid substrate from seeping out of the gap between the porous body 30 and the holder 60; and on the other hand, the second seal element 50 is located between the porous body 30 and the holder 60, which is advantageous for the porous body 30 to be stably accommodated in the holder 60 to avoid loosening.

In addition, a convex rib 53 at least partially surrounding the second seal element 50 is formed on the second seal element 50. After assembly, the convex rib 53 cooperates with the holder 60 through interference fit, to provide seal between the holder 60 and the porous body 30.

The first seal element 70 is at least partially arranged between the liquid storage cavity 12 and the holder 60, and the shape of the flexible first seal element 70 is adapted to the cross section of the inner contour of the main housing 10, so as to seal the liquid storage cavity 12 and prevent the liquid substrate from leaking out of the liquid storage cavity 12. Further, in order to prevent the shrinkage and deformation of the first seal element 70 made of the flexible materials from affecting the tightness of the sealing, the holder 60 is accommodated in the first seal element 70 to provide support for the first seal element 70.

After mounting, in order to ensure the smooth transmission of the liquid substrate and the output of the aerosol, the first seal element 70 is provided with a first liquid guide hole 71 for the liquid substrate to flow through, the holder 60 is correspondingly provided with a second liquid guide hole 61, and the second seal element 50 is provided with a third liquid guide hole 51. During use, the liquid substrate in the liquid storage cavity 12 flows to the porous body 30 held in the second seal element 50 via the first liquid guide hole 71, the second liquid guide hole 61, and the third liquid guide hole 51 successively as shown by arrow R1 in FIG. 4 and FIG. 5, then the liquid substrate is absorbed and transferred to the vaporization surface 310 for vaporization, and the generated aerosol is released into the vaporization chamber 340 defined between the vaporization surface 310 and the end cap 20.

On an aerosol output path during the inhalation process, referring to FIG. 3 to FIG. 5, the flexible seal element 70 is provided with a first insertion hole 72 for a lower end of the flue gas transmission pipe 11 to plug in, the holder 60 is correspondingly provided with a second insertion hole 62, and an opposite side of the holder 60 to the main housing 10 is provided with an aerosol output channel 63 through which the vaporization surface 310 is in airflow communication with the second insertion hole 62. A complete inhalation airflow path after mounting is shown by arrow R2 in FIG. 3. The external air enters the vaporization chamber 340 via the first air inlet 23 on the end cap 20, then carries the generated aerosol to flow from the aerosol output channel 63 to the second insertion hole 62, and then outputs to the flue gas transmission pipe 11 via the first insertion hole 72.

Figure 6:
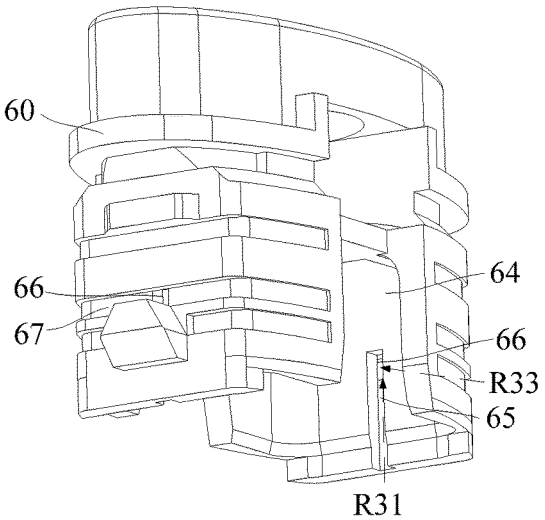
FIG. 6 is a schematic structural diagram of a holder shown in FIG. 5 from another perspective.
Figure 7:
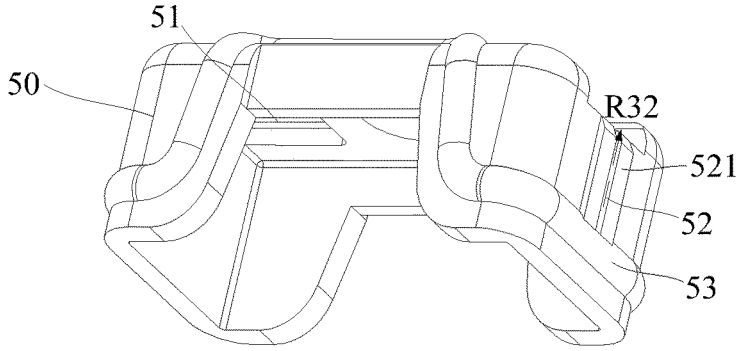
FIG. 7 is a schematic structural diagram of a second seal element shown in FIG. 5 from another perspective.

Further, referring to FIG. 6, a first vent groove 65 extending in a longitudinal direction is provided on an inner side wall of the holding space 64 of the holder 60 in a width direction; and the holder 60 is further provided with a vent hole 66 extending from the side wall into the first vent groove 65. FIG. 7 shows a schematic structural diagram of a second seal element 50 cooperating with the holder 60. A second vent groove 52 defined by a gap between two convex edges 521 extending in the longitudinal direction is provided at a position on a side wall of the second seal element 50 opposite to the first vent groove 65.

The second seal element 50 and the holder 60 cooperate to generate an air channel for air to enter the liquid storage cavity 12, to relieve or balance negative pressure in the liquid storage cavity 12. For a specific structure of an air channel formed through cooperation between the second seal element 50 and the holder 60, reference may be made to FIG. 8.

Figure 8:
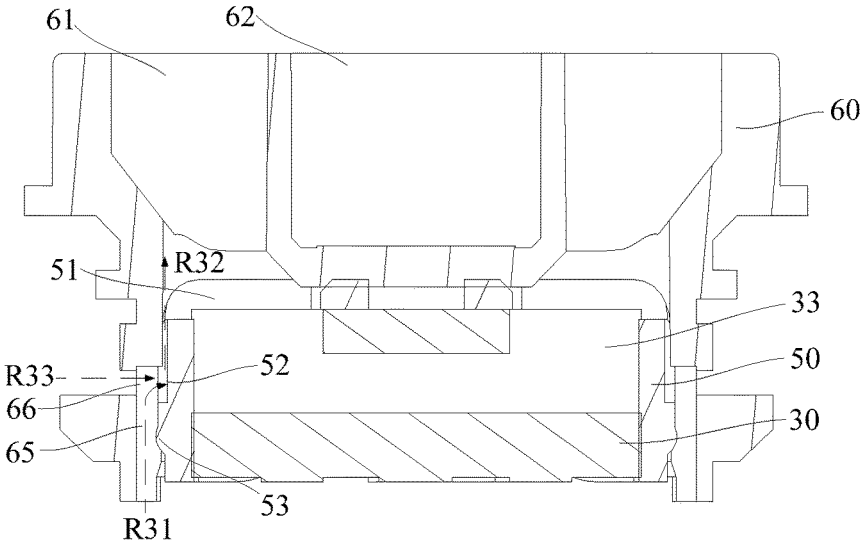
FIG. 8 is a schematic diagram of forming an air channel between the holder and the second seal element shown in FIG. 5.

In the implementation, a part of external air enters the first vent groove 65 along a first path part R31 shown in FIG. 6 and FIG. 8, enters the second vent groove 52 through an overlapping portion of the first vent groove 65 and the second vent groove 52 of the second seal element 50, and finally extends into a liquid guide channel along a second path part R32 and the second vent groove 52 shown in FIG. 8 to enter the liquid storage cavity 12.

In addition, there may further be a part of air entering the first vent groove 65 through the vent hole 66 along a third path part R33 shown in FIG. 8, entering the second vent groove 52 through an upper end of a portion where the first vent groove 65 overlaps the second vent groove 52 of the second seal element 50, and finally extending into the liquid guide channel along the second path part R32 and the second vent groove 52 shown in FIG. 8 to enter the liquid storage cavity 12.

Further, as shown in FIG. 6 and FIG. 7, a width or a cross-sectional area of the first vent groove 65 is greater than that of the second vent groove 52. Therefore, during use, a cross-sectional area of the first path part R31 is greater than that of the second path part R32. During implementations, the width of the first vent groove 65 is approximately in a range of 1 mm to 3 mm, and the width of the second vent groove 52 is approximately in a range of 0.5 mm to 2 mm. In addition, during implementations, the formed first path part R31 and second path part R32 are relatively staggered in the longitudinal direction.

As shown in FIG. 6 to FIG. 8, an extension length of the first vent groove 65 in the longitudinal direction at least partially overlaps an extension length of the second vent groove 52, and air communication is implemented through an overlapping portion of the first vent groove 65 and the second vent groove 52.

Further, as shown in FIG. 8, the extension length of the first vent groove 65 after assembly extends through a convex rib 53 that is of the second seal element 50 and that extends in a circumferential direction. The convex rib 53 defines an interference fit region between the second seal element 50 and the holder 60, and after assembly, a gap between the second seal element 50 and the holder 60 is completely sealed as much as possible to prevent leakage of the liquid substrate. In a preferred implementation, the holder closely abuts against one side of the convex rib 53, and a wall of the porous body 30 closely abuts against another side of convex rib 53, to clamp together from both inside and outside to form interference fit.

As can be seen from the above, air flows through the convex rib 53 of the second seal element 50 through a lower side of the porous body 30/vaporization assembly away from the liquid storage cavity 12, and then enters the liquid storage cavity 12 through an upper side of the porous body 30/vaporization assembly close to the liquid storage cavity 12.

In a preferred implementation, the first vent groove 65 and/or the second vent groove 52 has a depth approximately in a range of 0.5 mm to 2 mm. More preferably, the depth of the first vent groove 65 and/or the second vent groove 52 is greater than the width, which can effectively suppress an impact of deformation of the flexible second seal element 50 on an area of the air channel, and ensure that the area of the air channel area is kept in a sufficient size to enable air to smoothly flow into the liquid storage cavity 12.

Figure 9:
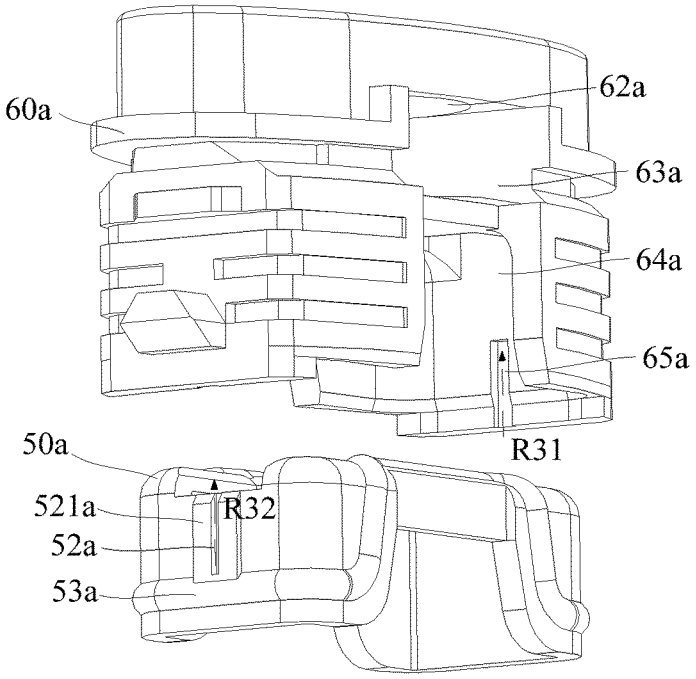
FIG. 9 is a schematic exploded view of a holder and a second seal element before assembly according to another embodiment.
Figure 10:
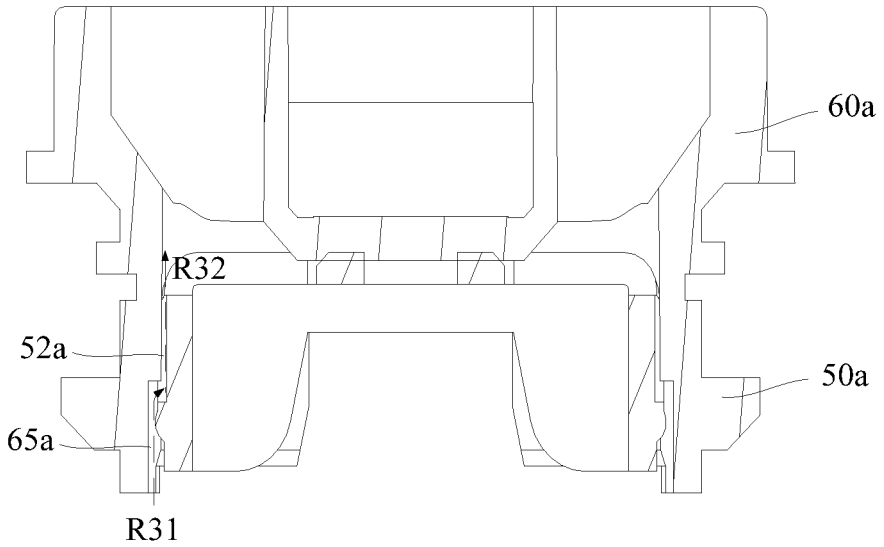
FIG. 10 is a schematic diagram of forming an air channel between the holder and the second seal element shown in FIG. 9.

Further, in an embodiment of forming another air channel shown in FIG. 9 and FIG. 10, a first vent groove 65*a* extending in a longitudinal direction is provided on an inner side wall of a holding space 64*a* of a holder 60*a* in a width direction; and a second vent groove 52*a* defined by a gap between two convex edges 521*a* extending in the longitudinal direction is provided at a position on a side wall of a second seal element 50*a* opposite to the first vent groove 65*a*.

After assembly, external air enters the first vent groove 65*a* along a first path part R31 shown in FIG. 10, enters the second vent groove 52*a* through an upper end of the first vent groove 65*a*, and finally extends into the liquid guide channel along the second path part R32 and the second vent groove 52*a* shown in FIG. 8 to enter the liquid storage cavity 12. In this embodiment, an extension length of the first vent groove 65*a* is shorter than the extension length of the first vent groove 65 shown in FIG. 6, and therefore, a vent hole 66 formed through convergence with a capillary groove 67 is not provided.

Figure 11:
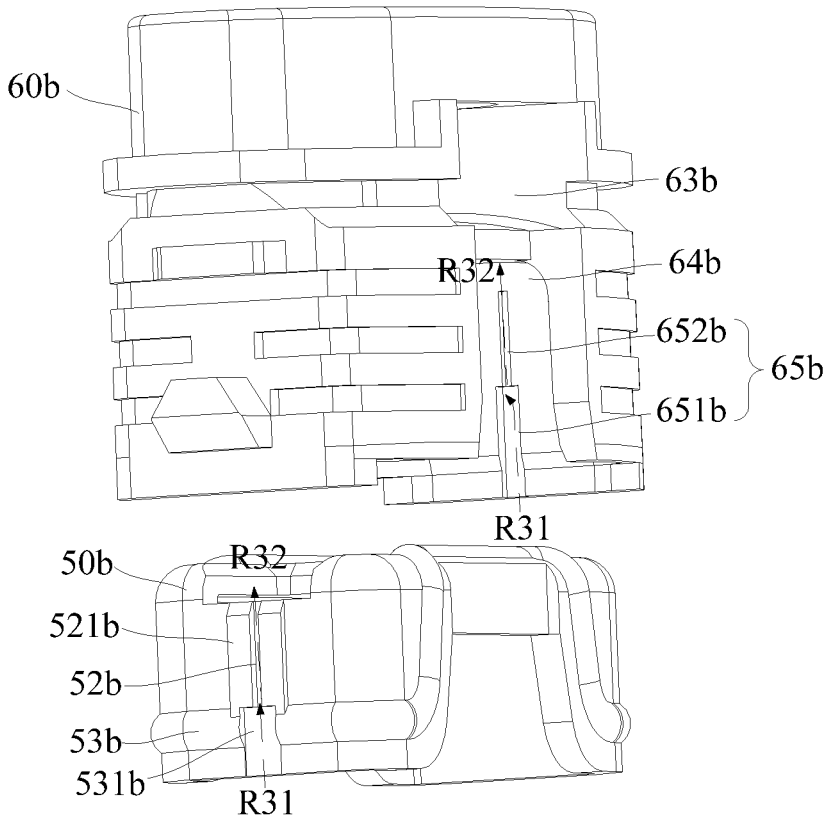
FIG. 11 is a schematic exploded view of a holder and a second seal element before assembly according to still another embodiment.

Further, in an embodiment of forming another air channel shown in FIG. 11, a first vent groove 65*b* extending in the longitudinal direction is provided on an inner side wall of a holding space 64*b* of the holder 60*b*. The first vent groove 65*b* has a first section 651*b* and a second section 652*b* sequentially arranged in the longitudinal direction. The first section 651*b* has a width greater than a width of the second section 652*b*. In this embodiment, an extension length of the first vent groove 65*b* is longer than the extension length of the first vent groove 65/65*a*. In a preferred implementation, the width of the first section 651*b* is approximately in a range of 1 mm to 3 mm; and the width of the second section 652*b* is approximately in a range of 0.5 mm to 2 mm.

In FIG. 11, an outer side surface of a second seal element 50*b* is provided with a second vent groove 52*b* defined by a gap between two convex edges 521*b*. In addition, a convex rib 53*b* is not in a complete ring shape, but is provided with a notch 531*b*, and the notch 531*b* is in airflow communication with the second vent groove 52*b* to enlarge an area for entering the air channel. Certainly, the notch 531*b* is opposite to the first section 651*b* of the first vent groove 65*b*.

After a holder 60*b* and the second seal element 50*b* shown in FIG. 11 are assembled, external air enters through a channel formed between the first section 651*b* of the first vent groove 65*b* and the notch 531*b* along the first path part R31, and then is transferred to the second path part R32 defined between the second section 652*b* of the first vent groove 65*b* and the second vent groove 52*b* and overflows into the liquid storage cavity 12.

In this embodiment of FIG. 11, the second vent groove 52*b* is substantially opposite to the second section 652*b* of the first vent groove 65*b*.

In this embodiment of FIG. 11, a convex rib 53*b* of the second seal element 50*b* avoids the first section 651*b* of the first vent groove 65*b* through the notch 531*b*, to avoid a problem of insufficient consistency of a cross-sectional area of the air channel due to extrusion and deformation of the flexible convex rib 53*b* during assembly.

Alternatively, in another variant implementation, the first path part R31 is defined by the notch 531*b* of the convex rib 53*b* on an outer side wall of the second seal element 50*b* shown in FIG. 11; and the second path part R32 is defined by the second vent groove 52*b* defined by the gap between the two convex edges 521*b*. In a corresponding implementation, a configuration of the first vent groove 65*b* on an inner wall of the holder 60*b* may be omitted.

Figure 12:
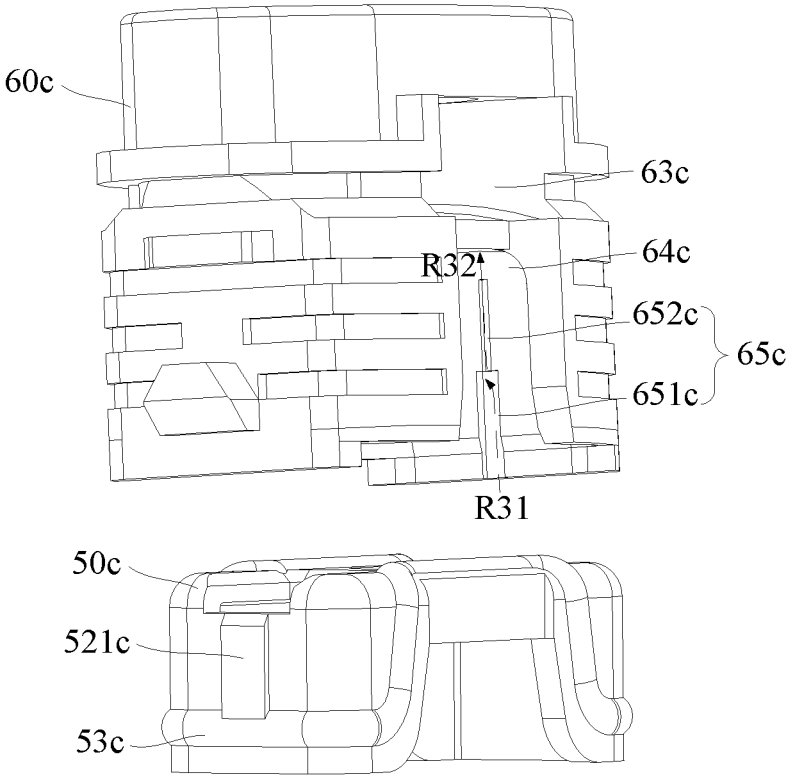
FIG. 12 is a schematic exploded view of a holder and a second seal element before assembly according to yet another embodiment.

FIG. 12 shows a holder 60*c* and a second seal element 50*c* according to another embodiment. In an embodiment of forming an air channel, an inner side wall of the holder 60*c* is provided with a first vent groove 65*c* extending in the longitudinal direction. The first vent groove 65*c* has a first section 651*c* and a second section 652*c* sequentially arranged in the longitudinal direction. The first section 651*c* has a width greater than a width of the second section 652*c*.

Further, in FIG. 12, a boss 521*c* is arranged on a surface opposite to the second seal element 50*c*. After assembly, the first section 651*c* of the first vent groove 65*c* extends through a convex rib 53*c* of the second seal element 50*c*, to form a first path part R31. The boss 521*c* abuts against the inner side wall of the holder 60*c*, and defines a second path part R32 with the second section 652*c* of the first vent groove 65*c*.

In an implementation of FIG. 12, a surface of the boss 521*c* is planar and abuts against the inner side wall of the holder 60*c*, and after assembly, the boss 521*c* may not extend into the second section 652*c* of the first vent groove 65*c* and reduce a cross-sectional area of the air channel.

Further, according to FIG. 8 and the foregoing embodiments, the first path part R31 extends through the convex rib 53/53*a*/53*b*/53*c* on the second seal element 50/50*a*/50*b*/50*c* in the longitudinal direction. In addition, the second path part R32 is opposite to a liquid channel 33 of the porous body 30. In this way, when defining the second path part R32, the second seal element 50/50*a*/50*b*/50*c* is not extruded by the porous body 30, so that a channel area of the second path part R32 is not reduced due to deformation of the second seal element 50/50*a*/50*b*/50*c*. Further, in a more preferred implementation, a protrusion height of the convex rib 53/53*a*/53*b*/53*c* is greater than or equal to a protrusion height of the convex edge 521/521*a*/521*b* or the boss 521*c*.

The air channel is defined by a vent groove between the holder 60/60*a*/60*b*/60*c* and the second seal element 50/50*a*/50*b*/50*c*, which makes mold production easier than a manner such as drilling, and can effectively avoid an impact of extrusion or deformation of the second seal element 50/50*a*/50*b*/50*c* on the cross-sectional area of the air channel.

It is to be noted that, this specification of this application and the accompanying drawings thereof illustrate preferred embodiments of this application, but this application is not limited to the embodiments described in this specification. Further, a person of ordinary skill in the art may make improvements or modifications according to the foregoing description, and all the improvements and modifications shall fall within the protection scope of the attached claims of this application.

What is claimed is:

1. A vaporizer, comprising:

a housing, having a liquid storage cavity configured to store a liquid substrate;

a vaporization assembly, configured to vaporize at least a part of the liquid substrate to generate an aerosol, wherein the vaporization assembly has a first side facing the liquid storage cavity and a second side opposite to the first side;

a holder, having a holding space in fluid communication with the liquid storage cavity, wherein the vaporization assembly is at least partially accommodated in the holding space;

a seal element, being flexible and at least partially located between the holder and the vaporization assembly, wherein the seal element has an interference fit region, and is configured to provide seal between the holder and the vaporization assembly through interference fit; and an air channel configured to provide an airflow path for air to enter the liquid storage cavity, wherein the air channel extends in a direction from the second side toward the first side;

wherein the air channel comprises a first channel portion and a second channel portion, both the first channel portion and the second channel portion being formed between the holder and a side wall of the seal element;

wherein the first channel portion extends through the interference fit region, and the second channel portion avoids the interference fit region; and wherein the first channel portion and the second channel portion are offset from each other in a longitudinal direction of the housing.

2. The vaporizer according to claim 1, wherein a convex rib at least partially surrounding the seal element is arranged on an outer surface of the seal element, and the convex rib defines the interference fit region.

3. The vaporizer according to claim 2, wherein the second channel portion is positioned closer to the liquid storage cavity than the first channel portion in the longitudinal direction of the housing.

4. The vaporizer according to claim 3, wherein the first channel portion has a larger cross-sectional area than the second channel portion.

5. The vaporizer according to claim 4, wherein an inner surface of the holder is provided with a first vent groove and is at least partially defined by the first vent groove to form the first channel portion; and an outer surface of the seal element is provided with a second vent groove and is at least partially defined by the second vent groove to form the second channel portion, wherein:

an extension length of the first vent groove in the longitudinal direction of the housing at least partially overlaps an extension length of the second vent groove, and the first vent groove is in airflow communication with the second vent groove at an overlapping portion.

6. The vaporizer according to claim 5, wherein an outer surface of the holder is provided with a capillary groove at least partially extending in a circumferential direction of the holder; and the capillary groove is arranged to extend through the overlapping portion, and forms a hole at an intersection with the overlapping portion for air to enter the overlapping portion.

7. The vaporizer according to claim 1, wherein the second channel portion is positioned closer to the liquid storage cavity than the first channel portion in the longitudinal direction of the housing.

8. The vaporizer according to claim 7, wherein the first channel portion has a larger cross-sectional area than the second channel portion.

9. The vaporizer according to claim 7, wherein an inner surface of the holder is provided with a first vent groove and is at least partially defined by the first vent groove to form the first channel portion; and an outer surface of the seal element is provided with a second vent groove and is at least partially defined by the second vent groove to form the second channel portion, wherein:

an extension length of the first vent groove in the longitudinal direction of the housing at least partially overlaps an extension length of the second vent groove, and the first vent groove is in airflow communication with the second vent groove at an overlapping portion.

10. The vaporizer according to claim 9, wherein an outer surface of the holder is provided with a capillary groove at least partially extending in a circumferential direction of the holder; and the capillary groove is arranged to extend through the overlapping portion, and forms a hole at an intersection with the overlapping portion for air to enter the overlapping portion.

11. The vaporizer according to claim 7, wherein an inner surface of holder is provided with a first vent groove extending in the longitudinal direction of the housing, and the first vent groove comprises a first section facing away from the liquid storage cavity and a second section close to the liquid storage cavity, wherein:

the first section has a width, a depth, and a cross-sectional area that are greater than a width, a depth, and a cross-sectional area of the second section; and the first section at least partially defines the first channel portion, and the second section at least partially defines the second channel portion.

12. The vaporizer according to claim 11, wherein a boss opposite to the second section is arranged on an outer surface of the seal element, and a space between the boss and the second section defines the second channel portion.

13. The vaporizer according to claim 7, wherein the seal element is provided with a notch formed in the interference fit region; and the notch at least partially defines the first channel portion.

14. The vaporizer according to claim 7, wherein at least two convex edges are arranged on an outer surface of the seal element, and a gap between the at least two convex edges forms the second channel portion.

15. The vaporizer according to claim 7, wherein the vaporization assembly comprises a liquid channel running through the vaporization assembly in a length direction, and is in fluid communication with the liquid storage cavity through the liquid channel to absorb the liquid substrate; and the side wall is opposite to the liquid channel in the length direction.

16. The vaporizer according to claim 7, further comprising:

a vaporization chamber, at least partially defined by the vaporization assembly, and configured to accommodate the aerosol generated by the vaporization assembly, wherein:

the first channel portion is in communication with the vaporization chamber, to allow air in the vaporization chamber to enter the liquid storage cavity during use.

17. The vaporizer according to claim 1, wherein the air channel comprises a groove formed on an inner surface of the holder and/or a groove formed on an outer surface of the seal element.

18. The vaporizer according to claim 1, wherein the side wall of the seal element extends in the longitudinal direction of the housing.

19. An electronic vaporization device, comprising a vaporizer for vaporizing a liquid substrate to generate an aerosol, and a power supply mechanism for supplying power to the vaporizer, wherein the vaporizer comprises the vaporizer according to claim 1.

* * * * *